US006315405B1

(12) United States Patent
Chen et al.

(10) Patent No.: US 6,315,405 B1
(45) Date of Patent: Nov. 13, 2001

(54) INK JET PRINTING METHOD

(75) Inventors: Tienteh Chen, Penfield; Lixin Chu, Rochester, both of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/535,698

(22) Filed: Mar. 27, 2000

(51) Int. Cl.[7] ..... B41J 3/407
(52) U.S. Cl. ..... 347/106; 347/105; 347/100
(58) Field of Search ..... 347/100, 106, 347/105, 101, 107

(56) References Cited

U.S. PATENT DOCUMENTS 5,431,956 * 7/1995 Robb et al. ..... 427/220
5,549,740 * 8/1996 Takahashi et al. ..... 347/100
5,696,182 * 12/1997 Kashiwazaki et al. ..... 106/31.43

FOREIGN PATENT DOCUMENTS 813978 12/1997 (EP) .
0813978-A1 * 12/1997 (EP) ..... B41M/5/00

* cited by examiner

*Primary Examiner*—John Barlow
*Assistant Examiner*—Manish Shah
(74) *Attorney, Agent, or Firm*—Harold E. Cole

(57) ABSTRACT

An ink jet printing method, comprising the steps of:

A) providing an ink jet printer that is responsive to digital data signals;

B) loading the printer with ink jet recording elements comprising a substrate having thereon an image-receiving layer comprising inorganic particles encapsulated with an organic polymer having a Tg of less than about 20° C., the weight ratio of the inorganic particles to the organic polymer being from about 20 to about 0.2;

C) loading the printer with an ink jet ink composition; and

D) printing on the ink jet recording element using the ink jet ink in response to the digital data signals.

5 Claims, No Drawings

INK JET PRINTING METHOD

CROSS REFERENCE TO RELATED APPLICATIONS

Reference is made to commonly assigned, co-pending U.S. patent application Ser. No. 09/535,703 by Chu et al., filed concurrently herewith entitled "Ink Jet Recording Element"; the disclosure of which is hereby incorporated by reference.

FIELD OF THE INVENTION

This invention relates to an ink jet printing method. More particularly, this invention relates to an ink jet printing method employing an ink jet recording element containing encapsulated particles.

BACKGROUND OF THE INVENTION

In a typical ink jet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water, an organic material such as a monohydric alcohol, a polyhydric alcohol or mixtures thereof.

An ink jet recording element typically comprises a support having on at least one surface thereof an ink-receiving or image-forming layer, and includes those intended for reflection viewing, which have an opaque support, and those intended for viewing by transmitted light, which have a transparent support.

While a wide variety of different types of image-recording elements for use with ink jet devices have been proposed heretofore, there are many unsolved problems in the art and many deficiencies in the known products which have limited their commercial usefulness.

It is well known that in order to achieve and maintain photographic-quality images on such an image-recording element, an ink jet recording element must:

- Be readily wetted so there is no puddling, i.e., coalescence of adjacent ink dots, which leads to non-uniform density
- Exhibit no image bleeding
- Exhibit the ability to absorb high concentrations of ink and dry quickly to avoid elements blocking together when stacked against subsequent prints or other surfaces
- Exhibit no discontinuities or defects due to interactions between the support and/or layer(s), such as cracking, repellencies, comb lines and the like
- Not allow unabsorbed dyes to aggregate at the free surface causing dye crystallization, which results in bloom or bronzing effects in the imaged areas
- Have an optimized image fastness to avoid fade from contact with water or radiation by daylight, tungsten light, or fluorescent light An ink jet recording element that simultaneously provides an almost instantaneous ink dry time and good image quality is desirable. However, given the wide range of ink compositions and ink volumes that a recording element needs to accommodate, these requirements of ink jet recording media are difficult to achieve simultaneously.

Ink jet recording elements are known that employ porous or non-porous single layer or multilayer coatings that act as suitable image receiving layers on one or both sides of a porous or non-porous support. Recording elements that use non-porous coatings typically have good image quality but exhibit poor ink dry time. Recording elements that use porous coatings typically contain colloidal particulates and have poorer image quality but exhibit superior dry times.

While a wide variety of different types of porous image-recording elements for use with ink jet printing are known, there are many unsolved problems in the art and many deficiencies in the known products which have severely limited their commercial usefulness. The challenge of making a porous image-recording layer is to achieve a high gloss level without cracking, high color density, and a fast drying time.

EP 813,978 relates to an ink jet recording element wherein an ink absorption layer is used comprising fine particles, a hydrophilic binder and oil drops. However, there is a problem with this element in that the oil drops will migrate to the surface and cause changes in the appearance of the image.

It is an object of this invention to provide an ink jet printing method using an ink jet recording element that has a fast ink dry time. It is another object of this invention to provide an ink jet printing method using an ink jet recording element that has good image quality.

SUMMARY OF THE INVENTION

These and other objects are achieved in accordance with the invention which comprises an ink jet printing method comprising the steps of:

A) providing an ink jet printer that is responsive to digital data signals;

B) loading the printer with ink jet recording elements comprising a substrate having thereon an image-receiving layer comprising inorganic particles encapsulated with an organic polymer having a Tg of less than about 20° C., the weight ratio of the inorganic particles to the organic polymer being from about 20 to about 0.2;

C) loading the printer with an ink jet ink composition; and

D) printing on the ink jet recording element using the ink jet ink in response to the digital data signals.

The ink jet recording element obtained by the process of the invention provides a fast ink dry time and good image quality.

DETAILED DESCRIPTION OF THE INVENTION

The substrate used in the invention may be porous such as paper or non-porous such as resin-coated paper; synthetic paper, such as Teslin® or Tyvek®; an impregnated paper such as Duraform®; cellulose acetate or polyester films. The surface of the substrate may be treated in order to improve the adhesion of the image-receiving layer to the support. For example, the surface may be corona discharge treated prior to applying the image-receiving layer to the support. Alternatively, an under-coating or subbing layer, such as a layer formed from a halogenated phenol or a partially hydrolyzed vinyl chloride-vinyl acetate copolymer, can be applied to the surface of the support.

Any inorganic particle may be used in the invention, such as metal oxides or hydroxides. In a preferred embodiment of the invention, the metal oxide is silica available commercially as Nalco® (Nalco Co.), Ludox® (DuPont Corp), Snowtex® (Nissan Chemical Co.), alumina, zirconia or titania. In another preferred embodiment of the invention, the particle size of said particles is from about 5 nm to about 1000 nm.

The encapsulated particles used in the invention may be prepared by silane coupling chemistry to modify the surface of inorganic colloids, followed by emulsion polymerization which can be found in "Emulsion Polymerization and Emulsion Polymers", edited by P. A. Lovell and M. S. El-Aassar, John Wiley and Sons, 1997.

Silane coupling agents useful for the modification of inorganic colloids include 3-aminopropyltriethoxysilane, 3-aminopropyltrimethoxysilane, 3-aminopropyldiethoxymethylsilane, 3-aminopropyldimethoxymethylsilane, 3-aminopropylethoxydimethylsilane, 3-aminopropylmethoxydimethylsilane, N-(2-aminoethyl)-3-aminopropyltrimethoxysilane, N-(2-aminoethyl)-3-aminopropyltriethoxysilane, N-(2-aminoethyl)-3-aminopropylmethyl dimethoxysilane, N-(2-aminoethyl)-3-aminopropylmethyldiethoxysilane, 4-aminobutyltriethoxysilane, 4-aminobutyltrimethoxysilane, N-(2-aminoethyl)-3-aminoisobutylmethyldimethoxysilane, and other silane coupler agents listed in Gelest catalogue, pp.105–259(1997). Most preferred silane coupling agents for the modification of inorganic colloids used in the invention include 3-aminopropyl-triethoxysilane, 3-aminopropyltrimethoxysilane, 3-aminopropyldiethoxymethylsilane, 3-aminopropyldimethoxymethylsilane, N-(2-aminoethyl)-3-aminopropyltrimethoxysilane, N-(2-aminoethyl)-3-aminopropyltriethoxysilane, N-(2-aminoethyl)-3-aminopropylmethyldimethoxysilane, N-(2-aminoethyl)-3-aminopropylmethyldiethoxysilane.

The organic polymer used for encapsulation of the inorganic particles employed in the invention has a Tg of less than about 20° C. preferably from about −50° C. to about 20° C. Examples of these polymers which may be used in the invention include homo- and copolymers derived from the following monomers: n-butyl acrylate, n-ethylacrylate, 2-ethylhexylacrylate, methoxyethylacrylate, methoxyethoxy-ethylacrylate, ethoxyethylacrylate, ethoxyethoxyethylacrylate, 2-ethylhexyl-methacrylate, n-propylacrylate, hydroxyethylacrylate, etc. and cationic monomers such as a salt of trimethylammoniumethyl acrylate and trimethylammoniumethyl methacrylate, a salt of triethylammoniumethyl acrylate and triethylammonium-ethyl methacrylate, a salt of dimethylbenzyl-ammoniumethyl acrylate and dimethylbenzylammonium-ethyl methacrylate, a salt of dimethylbutylammonium-ethyl acrylate and dimethylbutylammoniumethyl methacrylate, a salt of dimethylhexylammoniumethyl acrylate and dimethylhexylammoniumethyl methacrylate, a salt of dimethyloctyl-ammoniumethyl acrylate and dimethyloctyl-ammoniumethyl methacrylate, a salt of dimethyldodecey-lammoniumethyl acrylate and dimethyldocecyl-ammoniumethyl methacrylate, a salt of dimethyloctadecyl-ammoniumethyl acrylate and dimethyloctadecylammoniumethyl methacrylate, etc. Salts of these cationic monomers which can be used include chloride, bromide, methylsulfate, triflate, etc.

Examples of the organic polymers which can be used in the invention include poly(n-butylacrylate-co-vinylbenzyltrimethylammonium chloride), poly(n-butylacrylate-co-vinylbenzyltrimethylammonium bromide), poly(n-butylacrylate-co-vinylbenzyldimethylbenzylammonium chloride) and poly(n-butylacrylate-co-vinylbenzyldimethyloctadecylammonium chloride). In a preferred embodiment of the invention, the polymer can be poly(n-butyl acrylate), poly(2-ethylhexyl acrylate) poly(methoxyethylacrylate), poly(ethoxy-ethylacrylate), poly(n-butylacrylate-co-trimethylammoniumethyl acrylate), poly(n-butylacrylate-co-trimethylammoniumethyl methacrylate) or poly(n-butylacrylate-co-vinylbenzyltrimethylammonium chloride).

Following are examples of inorganic particles encapsulated with an organic polymer which can be used in the invention:

| Encapsulated Particles | Inorganic Particle (wt. %) | Organic Polymer Shell (wt. %) |
|---|---|---|
| 1 | Nalco ® 2329(83.3) | Poly(n-butylacrylate-co-trimethylammonium ethyl methacrylate)(11.1:5.6) |
| 2 | Nalco ® 2329(83.3) | Poly(n-butylacrylate-co-dimethylbenzylamonium ethylacrylate) (11.1:5.6) |
| 3 | Nalco ® 2329(83.3) | Poly(n-butylacrylate-co-trimethylammonium ethyl acrylate) (11.1:5.6) |
| 4 | Nalco ® 2329(70) | Poly(n-butylacrylate-co-trimethylammonium ethyl methacrylate)(15:15) |
| 5 | Nalco ® 2329(50) | Poly(n-butylacrylate-co-trimethylammonium ethyl methacrylate)(25:25) |
| 6 | Nalco ® 2329(80) | Poly n-butylacrylate (20) |
| 7 | Nalco ® 2329(90) | Poly(n-butylacrylate-co-trimethylammonium ethyl methacrylate)(5:5) |
| 8 | Nalco ® 2329(80) | Poly(n-butylacrylate-co-vinylbenzyltrimethylammonium chloride)(10:10) |
| 9 | Nalco ® 2329(70) | Poly(n-butylacrylate-co-vinylbenzyltrimethylammonium chloride)(15:15) |
| 10 | Nalco ® 2329(80) | Poly n-ethylhexylacrylate (20) |
| 11 | Ludox ® C1(83.3) | Poly(n-butylacrylate-co-trimethylammonium ethyl methacrylate)(11.1:5.6) |
| 12 | Ludox ® C1(88.2) | Poly n-butylacrylate (11.8) |
| 13 | Ludox ® C1(83.3) | Poly(n-butylacrylate-co-trimethylammonium ethyl acrylate) (11.1:5.6) |
| 14 | Ludox ® C1(70) | Poly n-butylacrylate (30) |
| 15 | Snowtex ® OL(83.3) | Poly(n-butylacrylate-co-trimethylammonium ethyl methacrylate)(11.1:5.6) |
| 16 | Snowtex ® OL (88.2) | Poly n-butylacrylate (11.8) |
| 17 | Snowtex OL (83.3) | Poly(n-butylacrylate-co-trimethylammonium ethyl acrylate) (11.1:5.6) |
| 18 | Snowtex ® OL (70) | Poly n-butylacrylate (30) |

A binder can also be used in the image-recording layer employed in the process of the invention, e.g., a water soluble polymer such as poly(vinyl alcohol), gelatin, poly(vinyl pyrrolidone), poly(2-ethyl-2-oxazoline), poly(2-methyl-2-oxazoline), poly(acrylamide), Chitosan, methylcellulose, ethyl cellulose, hydroxyethyl cellulose, hydroxypropyl cellulose, etc. Other binders can also be used such as low Tg polymer latexes such as poly(styrene-co-butadiene), a polyurethane latex, a polyester latex, poly(n-butyl acrylate), poly(n-butyl methacrylate), poly(2-ethylhexyl acrylate), a copolymer of n-butylacrylate and ethylacrylate, a copolymer of vinylacetate and n-butylacrylate, etc.

Other additives may also be included in the image-recording layer such as PH-modifiers like nitric acid, cross-linkers, rheology modifiers, surfactants, UV-absorbers, biocides, lubricants, dyes, dye-fixing agents or mordants, optical brighteners etc.

The ink jet coating may be applied to one or both substrate surfaces through conventional pre-metered or post-metered coating methods such as blade, air knife, rod, roll coating, etc. The choice of coating process would be determined from the economics of the operation and in turn, would determine the formulation specifications such as coating solids, coating viscosity, and coating speed.

The image-receiving layer thickness may range from about 1 to about 60 μm, preferably from about 5 to about 40 μm.

After coating, the ink jet recording element may be subject to calendering or supercalendering to enhance surface smoothness. In a preferred embodiment of the invention, the ink jet recording element is subject to hot, soft-nip calendering at a temperature of about 65° C. and a pressure of 14000 kg/m at a speed of from about 0.15 m/s to about 0.3 m/s.

Ink jet inks used to image the recording elements employed in the process of the present invention are well-known in the art. The ink compositions used in ink jet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference.

The following examples further illustrate the invention.

EXAMPLES

Example 1

Synthesis of Encapsulated Particle 1

150 g of Nalco® 2329 colloidal silica and 150 g of distilled water were mixed in a 500 mL 3-neck round bottom flask equipped with a mechanical stirrer and nitrogen inlet. 3 g of 3-aminopropylmethyldiethoxysilane was added over one min. The pH of the mixture was adjusted slowly to 4.0 with 1N HCl. The viscosity of the dispersion increased first in the beginning but reduced again with the addition of acid. 1.2 g of cetyltrimethylammonium bromide(CTAB) and 0.6 g of Triton X-100® were added. The dispersion was stirred one hour at room temperature.

The solution was heated to 80° C. in a constant temperature bath and purged with nitrogen for 30 min. 0.12 g of 2,2'azobis(2-methylpropionamidine) dihydrochloride was added to the reactor. A monomer emulsion comprising 8 g of n-butyl acrylate, 5 g of trimethylammonium ethylmethacrylate( methylsulfate salt, 80% solid), 0.24 g CTAB, 0.12 g 2,2'azobis(2-methylpropionamidine) dihydrochloride, and 40 g deionized water was fed to the reactor over one hour to encapsulate the Nalco® 2329. The % solid was 20.1 % and the particle size of the encapsulated particle was 45 nm.

Example 2

Element 1

To prepare the paper base, a coating suspension was made by mixing 93 parts precipitated calcium carbonate pigment (Alboglos-S®, Specialty Minerals Inc.) and 7 parts poly (vinyl alcohol) (Airvol 540®, Air Products and Chemicals) in an aqueous medium. The suspension was applied to a Georgia-Pacific 1 00# paper base by Meyer Rod with a dry thickness of 50 μm. The coating was oven dried at 60° C. An aqueous dispersion of the above encapsulated particle 1 was coated on the prepared base by Meyer Rod with a dry thickness of 10 μm. The coating was oven dried at 60° C.

Element 2

This element was prepared the same way as in Element 1 except that the coating was an aqueous dispersion comprising 80 parts of colloidal silica (Nyacol® IJ 222, Akzo Nobel) and 20 parts of the above encapsulated particle 1.

Comparative Element 1

This element was prepared the same way as in Element 1 except that the coating was an aqueous dispersion of colloidal silica (Nyacol® IJ 222, Akzo Nobel).

Comparative Example 2

This element was prepared the same way as in Element 1 except that the coating was an aqueous dispersion comprising 85 parts of colloidal silica (Nyacol® IJ 222, Akzo Nobel) and 15 parts of a polyurethane latex (Witcobond® W-213, Witco Corp.)

Comparative Example 3

This element was prepared the same way as in Element 1 except that the coating was an aqueous dispersion comprising 90 parts of colloidal silica (Nalco® 2329, Nalco Co.) and 10 parts of polyvinyl alcohol (Airvol® 540, Air Products and Chemicals).

Printing

Images were printed using an Epson Stylus Color 740 printer for dye-based inks using Color Ink Cartridge S020191/IC3CL01. The images comprised a series of cyan, magenta, yellow, black, green, red and blue strips, each strip being in the form of a rectangle 0.8 cm in width and 20 cm in length.

Dry Time

Immediately after ejection from the printer, a piece of bond paper was placed over the printed image and rolled with a smooth, heavy weight. Then the bond paper was separated from the printed image. The length of dye transfer on the bond paper was measured to estimate the time needed for the printed image to dry. The dry time was rated as 1 when there was no transfer of the inks to the bond paper. If there was a full transfer of at least one color strip, the dry time was rated as 5. Intermediate transfer lengths were rated in between 1 and 5.

Image Quality

The image quality was evaluated subjectively. Coalescence refers to the non-uniformity or puddling of the ink in solid filled areas. Bleeding refers to the inks flowing out of its intended boundaries.

Coating Appearance

The coatings were visually examined for cracking defects. The following results were obtained:

TABLE 1

| Element | Coating Appearance | Image Quality | Dry Time |
|---|---|---|---|
| 1 | Non-cracked | Fair density and image quality | 2 |
| 2 | Non-cracked | Sharp image, high density | 1 |
| Comparative 1 | Cracked, scaled up | Sharp image, low density | 1 |
| Comparative 2 | Cracked | Poor image, low density | 4 |
| Comparative 3 | Slightly cracked | Poor image, bleeding | 5 |

The above results show that the elements employed in the process of the invention had good dry time, no cracking and good image quality as compared to the control elements which had poorer dry times, had cracking and poorer image quality.

This invention has been described with particular reference to preferred embodiments thereof but it will be understood that modifications can be made within the spirit and scope of the invention.

What is claimed is:

1. An ink jet printing method, comprising the steps of:

A) providing an ink jet printer that is responsive to digital data signals;

B) loading said printer with ink jet recording elements comprising a substrate having thereon an image-receiving layer comprising inorganic particles encapsulated with an organic polymer having a Tg of less than about 20° C., the weight ratio of said inorganic particles to said organic polymer being from about 20 to about 0.2;

C) loading said printer with an ink jet ink composition; and

D) printing on said ink jet recording element using said ink jet ink in response to said digital data signals.

2. The method of claim 1 wherein said inorganic particles comprise a metal oxide or metal hydroxide.

3. The method of claim 2 wherein said metal oxide is silica, alumina, zirconia or titania.

4. The method of claim 1 wherein said particles have a particle size of from about 5 nm to about 1000 nm.

5. The method of claim 1 wherein said organic polymer is poly(n-butyl acrylate), poly(2-ethylhexyl acrylate), poly (methoxyethylacrylate), poly(ethoxyethylacrylate), poly(n-butylacrylate-co-trimethylammoniumethyl acrylate), poly (n-butylacrylate-co-trimethylammoniumethyl methacrylate) or poly(n-butylacrylate-co-vinylbenzyltrimethylammonium chloride).

* * * * *